US005115536A

United States Patent [19]

Jarvis

[11] Patent Number: 5,115,536

[45] Date of Patent: May 26, 1992

[54] ADJUSTABLE CONCRETE FINISHING TOOL

[76] Inventor: Jack D. Jarvis, 2054 Portland St., Memphis, Tenn. 38127

[21] Appl. No.: 498,979

[22] Filed: Mar. 26, 1990

[51] Int. Cl.[5] ..... E01C 19/12; B05C 17/10; E04F 21/24

[52] U.S. Cl. ..... 15/235.8; 15/235.4; 15/144 R; 15/DIG. 10; 81/177.8; 403/92; 404/97

[58] Field of Search ..... 15/235.4, 235.8, DIG. 10, 15/143 R, 144 R, 172, 235.6, 235.7; 81/177.7, 177.8, 177.9; 16/114 R; 404/97, 89, 88; 403/91, 92, 93

[56] References Cited

U.S. PATENT DOCUMENTS

| | | | |
|---|---|---|---|
| 661,563 | 11/1900 | Stockford | 403/93 X |
| 663,195 | 12/1900 | McGuire | 403/93 X |
| 737,951 | 9/1903 | McEachern | 403/93 X |
| 1,021,557 | 3/1912 | Runner | 404/97 |
| 1,120,947 | 12/1914 | Langager | 16/114 |
| 1,142,837 | 6/1915 | Nahr | 15/144 R |
| 1,161,627 | 11/1915 | DeFalco | 403/93 X |
| 1,519,246 | 12/1924 | Forshee et al. | 403/93 X |
| 1,929,660 | 10/1933 | Tullis . | |
| 1,952,398 | 3/1934 | Tullis . | |
| 3,082,460 | 3/1963 | Haivala . | |
| 3,090,984 | 5/1963 | Dunnigan | 15/235.4 |
| 3,162,881 | 12/1964 | Negwer . | |
| 3,264,668 | 8/1966 | Lasker . | |
| 3,798,701 | 3/1974 | Irwin et al. | 15/235.8 |
| 3,936,210 | 2/1976 | Oehlerking | 404/89 |
| 4,335,485 | 6/1982 | Paine et al. | 15/235.8 |
| 4,397,581 | 8/1983 | Jarvis | 404/97 |
| 4,399,583 | 8/1983 | Jarvis | 15/235.8 |
| 4,520,527 | 6/1985 | Maggio et al. | 15/144 R X |
| 4,702,641 | 10/1987 | Naser et al. | 15/236.8 X |
| 4,856,932 | 8/1989 | Kraft | 404/97 X |
| 4,892,437 | 1/1990 | Kraft | 404/97 |
| 4,929,112 | 5/1990 | Wilcox | 403/93 |

*Primary Examiner*—William A. Cuchlinski, Jr.
*Assistant Examiner*—James Folker
*Attorney, Agent, or Firm*—Paul M. Denk

[57] ABSTRACT

In combination with a bull float, hand trowel, groover, finisher, and the like, an elongated handle, which adjustably mounts through a bracket with the attachment means provided upon the upper portion of such a finishing tool, with the handle means incorporating a housing, spring biasing a detent therein, which is normally held into locking engagement with the tool bracket, as when the handle is threadedly engaged within its housing, or which can be readjusted into various other angular dispositions, for the convenience of the concrete finisher, by partially withdrawing the handle from its threaded engagement within its housing, thereby disengaging its detent from the bracket, to accommodate and faciliate the undertaking of such pivotal movement for the handle, during its readjustment.

5 Claims, 2 Drawing Sheets

ADJUSTABLE CONCRETE FINISHING TOOL

BACKGROUND OF THE INVENTION

This invention relates generally to a concrete finishing tools which incorporates means for providing for not only its adjustment longitudinally along the length of the tool, but more specifically, to furnish means for adjusting the angular relationship of the tool handle, with respect to its finishing component, regardless that the worker may be located some distance away from the tool as at the location of its handle end.

Concrete finishing tools have been available for decades, and are provided for furnishing convenient means for aiding the worker in providing a smooth texture to the surface of the freshly poured concrete, and before it sets. Such tools generally comprise what is identified as a concrete finisher, which includes a large trowel-like member, that incorporates a handle upon its surface and which can be conveniently grasped by the worker, to facilitate his/her manipulation of the tool, or hand float, during its usage and application. Such is shown in my earlier U.S. Pat. No. 4,399,583. In addition, other forms of concrete finishing tools are in the category of a groover, trowel, and more specifically, a bull float. These type of components are also shown in my earlier U.S. Pat. No. 4,397,581, as disclosed. As can be seen in my prior patent, and particularly the bull float embodiment, it included a handle attachment, which incorporated the connection of the handle through a connecting sleeve, for securement to the bosslike bracket member that connected with the bull float itself, as can be noted. But as also shown in that embodiment, it can be seen that a wing nut attachment cooperated with serrations or ribs provided upon the bracket, of the bosslike member, such that when the fastener was tightened, and the serrations interlock together, the handle was fixed angularly with respect to the bull float, at that angular position to which it was previously adjusted. The problem, as can be readily understood, is that when the finisher may have the bull float extended some distance, perhaps as much as ten to fifteen feet, out onto the concrete surface being finished, and in attempting to work the tool, the handle may extend upwardly at such an angle that it is totally inconvenient to the grasp of the worker, during its usage. Thus, in order to readjust the handle downwardly, the worker would have to pull the entire bull float back from the concrete surface, loosen the fastener and its wing nut, readjust the handle, and then shift it back out onto the concrete surface, in order to complete the project. Thus, not only is this inconvenient to the worker, consumes valuable time in his undertaking such manipulations in the setting of the tool, but likewise, the shifting of the bull float over the surface does have a tendency to cause imperfections to the surface, requiring its refinishing.

On the other hand, the current invention, as will be subsequently analyzed, can provide for a resetting and readjustment of its handle, with respect to the finishing tool, at the sight of its location, without necessitating the removal of the tool from the surface, as was required with previous tools, including the applicant's own prior design as shown in his said U.S. Pat. No. 4,397,581.

SUMMARY OF THE INVENTION

This invention relates to the provision of adjustment means into the structure of a concrete finishing tool, and whether it be of the bull float, finisher, groover, trowel, or the like, so as to facilitate the usage and application of any of these tools, embodying the invention of the current design, as during its application.

This invention envisions the construction of a concrete finishing tool, of the type that incorporates a plate means, and which incorporates attachment means for its handle to facilitate the securment of the handle to the device, and even its readjustment, during usage and application. The attachment means for the handle includes a housing-like means furnished at the tool end of the handle, and into which the handle may threadedly engage, and which housing is pivotally secured to a bracket member, that mounts, shiftably, with a pair of upstanding guide members that cooperate with a fastener for attachment of its bracket to the finishing tool. More specifically, the upstanding guide members include a pair of the same, spaced apart a fixed distance, and having inwardly projecting shoulders, and into which the head of a fastener may slideably insert, for extending upwardly and attain securement of the handle bracket thereto, during its initial setting and fixation. In addition, the invention more specifically includes means for providing for adjustment in the setting of the handle, angular-wise, with respect to the bracket that holds and connects it with the plate portion of the finishing tool. The handle housing of this invention includes a cavity therein, which embodies, in the preferred embodiment, internal threads, and into which the end of the handle, which likewise contains compatible threads, connects therein for securement of the handle within its housing, during assembly. Provided within the cavity of the housing is a detent means, that is longitudinally arranged therein, and which projects from the proximate end of the said housing. Spring means provided within the cavity, and surrounding the detent, normally retracts the detent into the housing, and its cavity, but that when the handle is threadedly engaged within the cavity, its projecting end encounters the detent and forces it further outwardly of the housing, and into engagement with the handle bracket, in order to fix the handle, at an adjusted angular position, with respect to the bracket, and the plate portion of the finishing tool to which it connects. The bracket of the finishing tool, which slide mounts along its length, in the manner as previously explained, includes some upwardly directed serrations, partially around the upper circumference of the bracket, and it is into these serrations that the detent may be forced, by the turned tightening of the handle within its housing, in order that the handle may be adjusted, angularly, at a desired position with respect to its bracket, and the finishing tool, in preparation for its usage.

Thus, in the manner as previously explained, when the concrete finisher may have this tool located some distance out on the setting concrete, perhaps even ten or more feet away, and is using it to finish remotely the surface of the freshly poured concrete, and desires to reset the angular position of the handle, with respect to the tool, all he/she need do is loosen by unthreading the handle from its housing, to some degree, until such time as the detent is retracted back into the cavity by means of the pressure and bias of its spring, until the detent disengages from the serrations of its proximate bracket, thereby allowing the handle to be pivoted to a new and readjusted position. When in its desired setting, as repositioned, the handle may be once again threaded within its housing, thereby forcing its detent exteriorly thereof, and into engagement with a proximate serration of the adjacent bracket, to refix the handle into an angled position with respect to the finishing tool, in preparation for its reapplication and usage.

It is, therefore, the principal object of this invention to provide a concrete finishing tool which provides convenient means for furnishing its readjustment during usage so as to minimize the effort and time required by the worker during its application.

Another object of this invention is to provide means for providing for readjustment in the setting of the tool, and more specifically with respect to its handle, without necessitating removal of the tool from its position of usage even far out at a distance upon the concrete surface being finished.

Still another object of this invention is to provide convenient means for adjusting a concrete finishing tool, in situ, during its application.

Still another object of this invention is to provide means for extending the handle length of a concrete finishing tool during its application and usage.

These and other objects will become more apparent to those skilled in the art upon reviewing the summary of this invention, and upon undertaking a study of the description of its preferred embodiment in view of the drawings.

BRIEF DESCRIPTION OF THE DRAWINGS

In referring to the drawings, FIG. 1 provides a top view of a concrete finishing tool showing, partially, the connection of the unique handle of this invention as attached thereto.

DESCRIPTION OF THE PREFERRED EMBODIMENT

Figure 1:
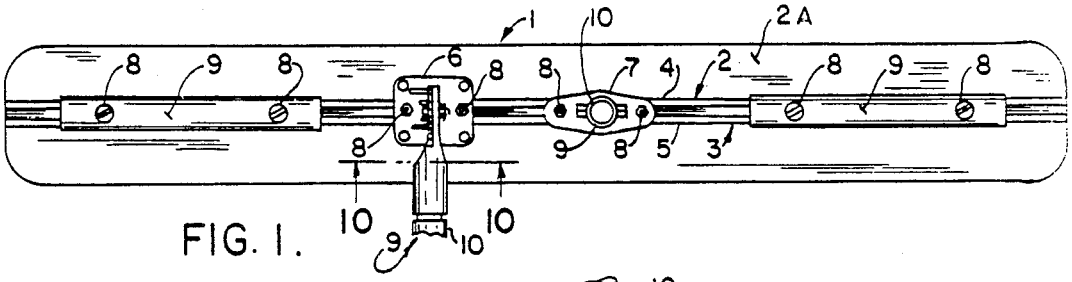
Figure 2:
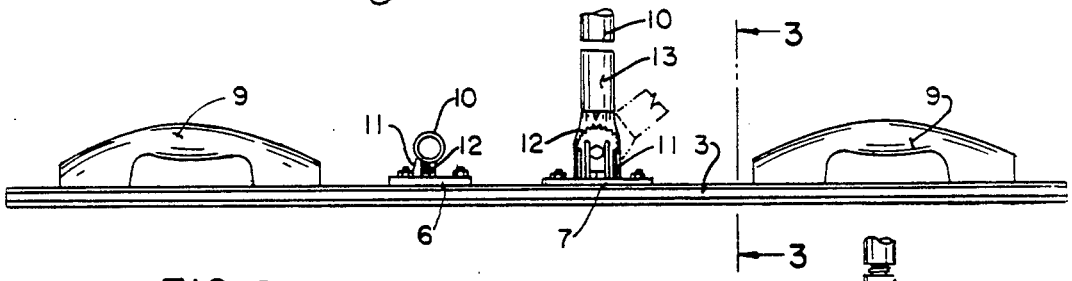
FIG. 2 provides a side view of the concrete finishing tool disclosed in FIG. 1.
Figure 3:
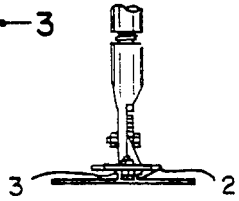
FIG. 3 provides an end view of the concrete finishing tool shown in FIG. 1, with the handle being repositioned to extend vertically.

In referring to the drawings, and in particular FIGS. 1 through 3, a concrete finishing tool 1 of this invention is disclosed, and which comprises a plate portion 2A which includes means for attachment of the various operating components to the finisher, formed as a pair of upstanding guide members 2 and 3, integrally upon the upper surface of the plate portion, with each upstanding portion having an inwardly directed shoulder, as at 4 and 5, respectively, as disclosed. See also FIG. 11. Thus, in the manner as previously explained in my patent U.S. Pat. No. 4,397,581, these upstanding members with their inturned flanges are designed for accommodating the insertion of a bolt therein, embracing its head, so that the threaded shank of the bolt extends upwardly, for attachment with bracket means, such as those as shown at 6 and 7. Various of the fastening bolts that are embraced by the attachment means are shown at 8, provided spacely along the length of the finishing tool, and useful for accommodating a variety of handle means that allow for the worker to grasp the tool and apply during a concrete finishing operation. These handle means in their various embodiments, are shown at 9, and are adjustable along the length of the tool. As can be seen, one of the handle means embodied herein includes a handle having substantial length, as shown at 10, and these handles are secured to their respective brackets 6 and 7, and adjustably mounted to the plate portion, in the manner as previously described. The other two handles disclosed at 9, provided at the extremes of the disclosed tool, are simply hand gripping handle devices as can be readily seen.

In the particular embodiment of this invention, and specifically with respect to the attachment means that secure the lengthy handles 10 to the finishing tool, as noted, the assembly means includes one of the brackets 6 and 7, as disclosed, and each of these brackets include an upstanding angular portion, generally right angled, as at 11, with the upper periphery or partial circumference of each bracket including a length of serrations along an edge, as at 12. Pivotally mounted to each of these brackets is the handle 10, or more specifically its handle housing, as shown at 13.

Figure 10:
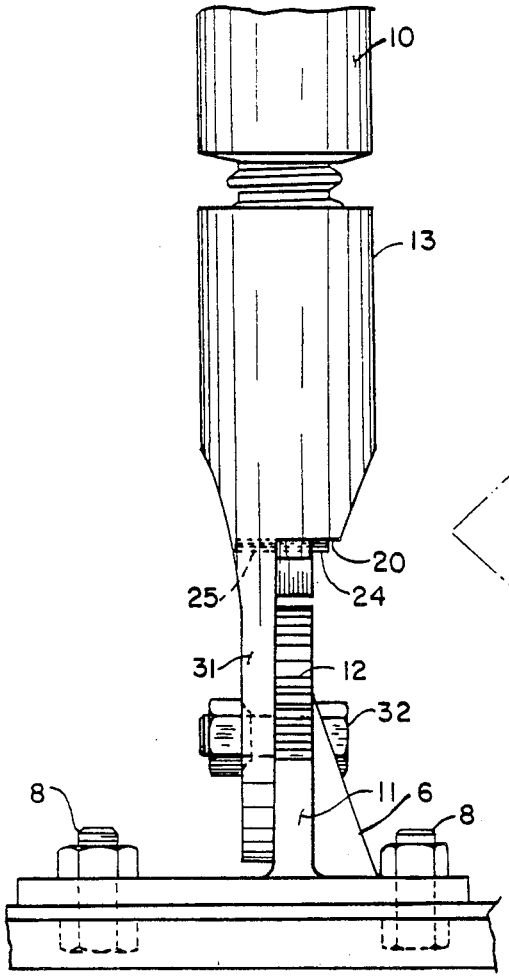
FIG. 10 is an enlarged view of that portion of the connection of the handle through its bracket with an upper part of the concrete finisher as shown in FIG. 1, taken along the line 10—10 of FIG. 1.
Figure 11:
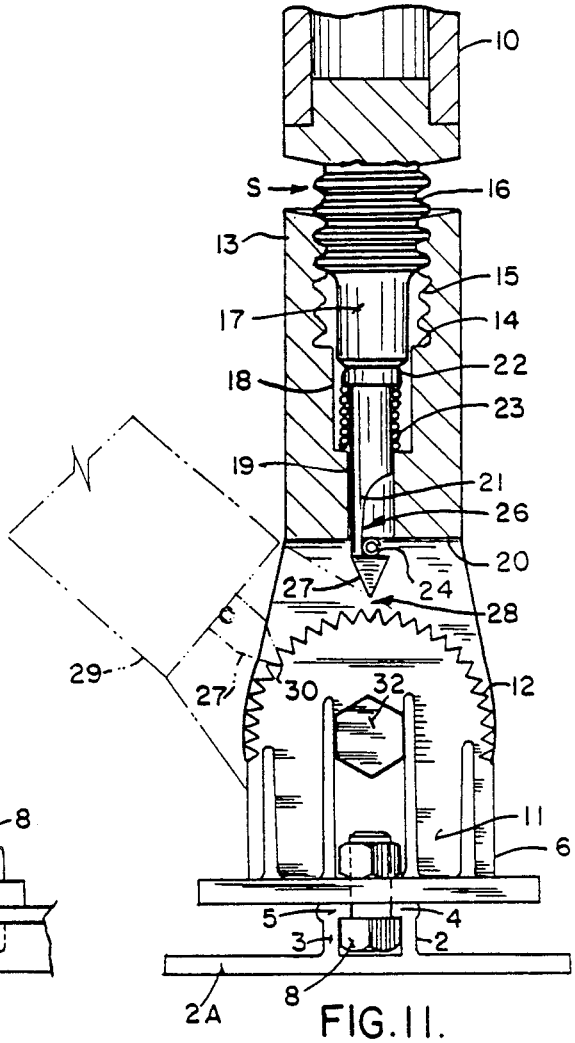
FIG. 11 is a side view of the invention as shown in FIG. 10.
Figure 12:
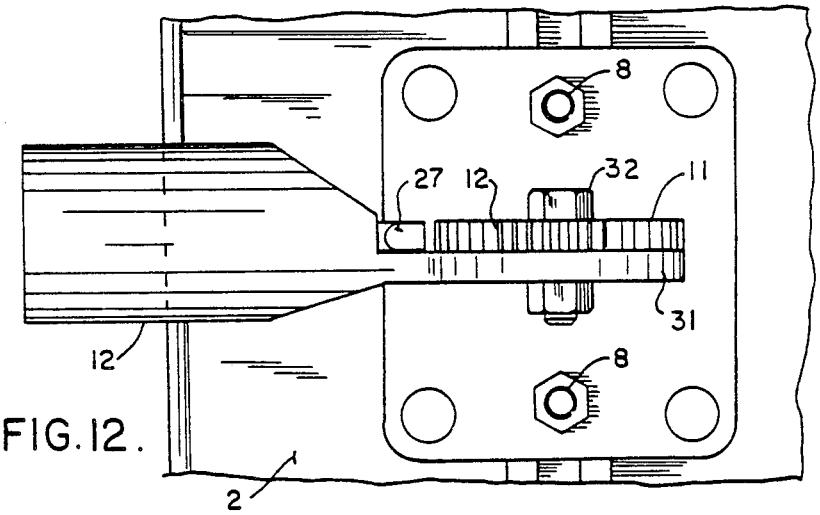
FIG. 12 is a top view of the invention as shown in FIG. 10.

The construction and function of the specific design for attachment of the style of handle 10 is best disclosed in referring to FIGS. 10 through 12. As shown, the handle comprises a substantial length of rod, as noted at 10, and this rod may have a length of a few feet up to as many as ten to fifteen feet in length. In addition, if additional sections of handle lengths are required, then additional segments of the handle rod 10 may be threadedly engaged together, in a manner as known in the art, to supplement the length of the handle, and determine the distance the worker may locate from the finishing tool, during its manipulation. The handle housing 13 has an internal cavity 14 provided therein, as disclosed. A portion of this cavity contains broad threads, as shown at 15, and it is into this threaded cavity that the forward end of the handle rod 10, as at 16, and which is likewise threaded, is disposed for threadedly mounting within the handle housing 12, as noted. Forwardly of the handle threads 16 are provided a projection 17, of reduced dimension, so as to have adequate clearance inwardly from the threads, and in addition, provide further clearance from the counterbore 18 provided further inwardly within the cavity 14 of the housing 12. A further channel 19 extends through the housing 12, as noted, and opens exteriorly at the housing shoulder 20, as seen. Provided for slide mounting through the channel 19 is a detent 21, and this detent extends inwardly of the housing, within the counterbore 18, where its upper integral head 22 provides for fixing of a spring means 23 therein, with the spring constantly biasing the detent upwardly into the housing, in a manner as can be understood. On the other hand, a pin 24 is mounted through the housing, as can be seen at 25, and is designed for providing for accommodating the clearance, as at 26, of the downward portion of the detent 19 to allow longitudinal shifting of the detent within the counterbore 19, so that when the spring 23 biases the detent upwardly within the housing, the projecting pointed edge, as at 27, encounters the pin, as can be seen in FIG. 11, to prevent or limit the extent of inward withdrawal of the detent into the housing 12. Under this condition, the handle rod 10 will be somewhat partially threadedly disengaged from within the threaded cavity 14, thereby allowing the spring to force the detent further inwardly of the housing 12, and thereby disengage the detent point 27 from the bracket serrations 12, by a clearance distance as shown at 28. Under this condition, the handle housing 12, through urging of its handle rod 10, can be pivoted, angularly with respect to the circumferential serrations 12 of the bracket 6 or 7, thereby allowing the handle, and its housing, to be pivoted to a different angular position for usage, such as shown in the phantom line 29, for the convenience of the concrete worker. Thus, when the handle and its housing is then shifted into a convenient position for usage, the handle rod 10 may be rethreaded within the cavity 14, allowing for its projection 17 to shift further inwardly or downwardly within the housing 12, until such time as it further urges the detent out of its counterbore 19, at such time as its pointed end 27 comes into engagement within one of the serrations, as shown at 30, to interlock the handle, through its housing, with the bracket, and to provide a fixed assembly of the handle with respect to the concrete finishing tool, in preparation for its reusage. When set in that usable condition, there still will be adequate spacing, as at S between the handle 10, and the upper edge of the housing 13, so as to prevent a binding engagement between these two components which would make it difficult to unthread these two components, when requiring a next resetting.

As can be noted, the bracket 11 that integrally extends upwardly into its upper formed circumferential serrated edge 12 pivotally mounts with the lower integral extension 31 of the handle housing 12, and held into position by means of the pivot pin fastener 32, as noted.

As can further be seen within these FIGS. 10 through 12, the fasteners 8 have one end that their head located within the attachment means, comprising those pair of upstanding members 2 and 3, and being embraced by their integral flanges 4 and 5, respectively, as previously explained. This will have fixed the bracket within the guide members of the attachment means, when initially locating the handle device somewhere along the length of the finishing tool, since normally, as can be seen in the figures, these upstanding members with their inwardly directed flanges extend longitudinally integrally along the length at the upper surface of the plate portion of each of the shown concrete finishing tools.

Figure 4:
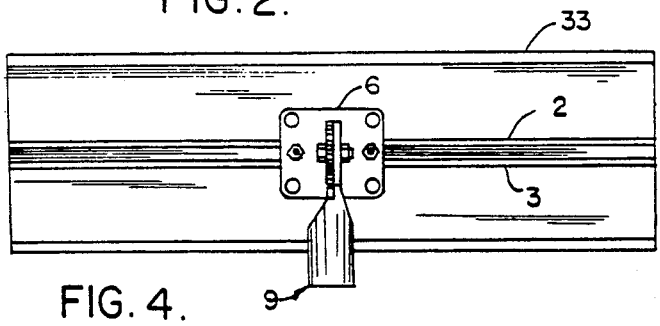
FIG. 4 is a top view of a bull float, showing the attachment of the novel adjustable handle connected thereto.
Figure 5:
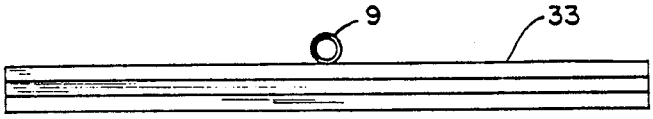
FIG. 5 is a side view of the bull float shown in FIG. 4.
Figure 6:
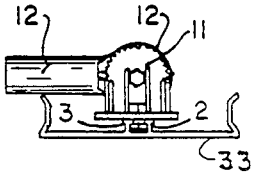
FIG. 6 is an end view of the bull float shown in FIG. 4.

As shown in FIGS. 4 through 6, a bull float, as at 33, and configured similarly to that as shown in my previous patent U.S. Pat. No. 4,397,581, includes similar type upstanding portions 2 and 3, for furnishing the attachment means to which the bracket 6 secures, for holding the adjustable handle 9 into position for usage, and to further provide for its reorientation angularly, in the manner as previously explained, to add to the convenience of the worker, and significantly to obviate the necessity for removal of the entire finishing tool, from a location on the concrete surface where it is being worked, as when it is required to readjust the handle at a new angular position, to continue the work of the concrete finisher, during performance of his/her skill.

Figure 7:
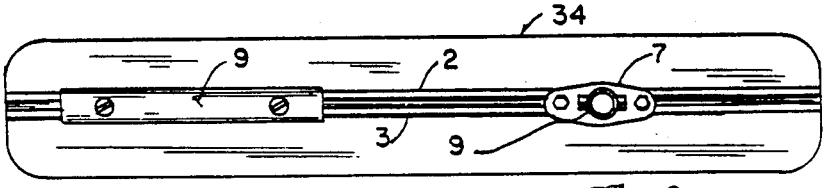
FIG. 7 is a top view of another form of concrete finisher having the adjustable handle of this invention attached therewith.
Figure 8:
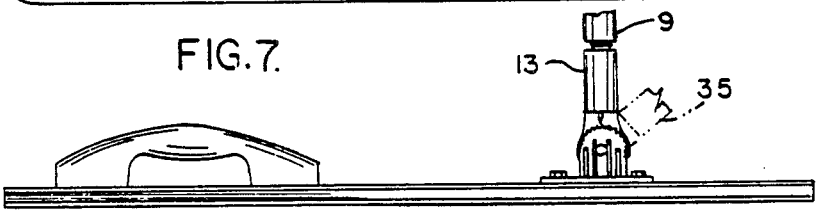
FIG. 8 is a side view of the concrete finisher as shown in FIG. 7.
Figure 9:
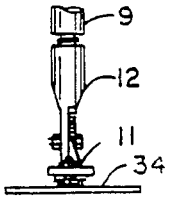
FIG. 9 is an end view of the concrete finisher shown in FIG. 7.

Furthermore, FIGS. 7 through 9 shown another embodiment for a concrete finishing tool, comprising a trowel or finisher generally called a handfloat, as at 34, and which may include one of the handles, as at 9, mounted proximate one end, along the length of its upstanding members 2 and 3, and likewise connect by means of this attachment means to the shown bracket 7 which secures a handle 9 thereto, and which can be adjusted, in the manner of manipulation as previously described, to various angular positions, as shown in FIG. 8. For example, the handle 9, through its housing 13, may extend vertically upwardly, or it may be pivoted downwardly at an angle, as shown at the phantom line at 35, for the convenience of its user. These are just examples of the variety of applications to the various types of concrete finishing tools that the adjustable handle means of this invention may be readily connected.

Variations or modifications to the subject matter of this invention may occur to those skilled in the art upon reviewing the subject matter of this disclosure. Such variations or modifications, if within the spirit of this invention, are intended to be encompassed within the scope of any claims to patent protection issuing upon this development. The description of the preferred embodiment set forth herein, as depicted in the drawings, are provided for illustrative purposes only.

Having thus described the invention, what is claimed and desired to be protected by Letters patent is:

1. An adjustable concrete finishing tool for use in finishing concrete or the like, comprising, a plate portion having a handle removably attached thereto, said plate portion having a bottom side for finishing of concrete, said plate portion having an upper side for attachment of said handle thereto, attachment means for the handle formed along the upper side of the plate portion, said handle removably connecting to said attachment means, and said handle upon its loosening from its connection with the attachment means providing for an adjustment in the angular relationship between the handle and the plate portion, so as to compensate for the height of the worker with respect to the distance from the concrete site being finished, whereby once readjusted, the handle means may be remotely reconnected and tightened within the attachment means for fixing the handle with respect to the plate portion and for use in the finishing of concrete, said attachment means for the handle formed along the upper side of the plate portion and extending for some length longitudinally thereof to allow for adjustment in the positioning of the handle upon the plate portion, said attachment means including a pair of upstanding members, each member having an inward shoulder projecting towards each other and thereby forming a clearance slot between the said members, at least one fastener having an enlarged head being accommodated within said slot, a bracket connecting at the lower end of the handle and securing with the fastener for holding the handle and the plate portion of the tool together in their adjusted positioning, said bracket including at least one angled member, said angled member having a pair of flanges, one flange of the angled member having an aperture therethrough for accommodating the said fastener, the other angle flange having a series of peripherally disposed serrations thereon, the lower end of the handle forming a housing, said housing pivotally connecting to the other angled flange and aligned therewith, said housing having a shiftable detent therein, said detent of the handle capable of interlocking within select of the serrations of the bracket in order to lock the handle with respect to its bracket and fix the angle of its disposition with respect to the finishing tool, said handle, when tightened within the bracket, extending said detent exteriorly of said handle housing for locking said handle with respect to its supporting bracket, and the loosening of said handle with respect to the bracket providing for retraction of its detent within the housing and disengagement from the bracket serration thereby providing for pivotal shifting of the handle for its readjustment, a spring means cooperating with said handle detent for normally urging said handle into its handle housing, and its disconnection from a bracket serration, and said handle when tightened within its housing, forcing said detent against its spring pressure to extend from the said housing and for engagement with a bracket serration.

2. The invention of claim 1 and wherein said finishing tool comprising a float.

3. The invention of claim 1 and wherein said finishing tool comprising a bull float.

4. The invention of claim 1 and wherein said finishing tool comprising a groover.

5. The invention of claim 2 and wherein said finishing tool comprising a hand float.

* * * * *

UNITED STATES PATENT AND TRADEMARK OFFICE

CERTIFICATE OF CORRECTION

PATENT NO. : 5,115,536.

DATED : May 26, 1992

INVENTOR(S) : Jack D. Jarvis

It is certified that error appears in the above-identified patent and that said Letters Patent is hereby corrected as shown below:

Column 8, claim 3, line 8, change "1" to ---2---.

Signed and Sealed this

Seventeenth Day of August, 1993

*Attest:*

*Attesting Officer*

BRUCE LEHMAN

*Commissioner of Patents and Trademarks*